US005584202A

United States Patent [19]

Kanamaru et al.

[11] Patent Number: 5,584,202

[45] Date of Patent: Dec. 17, 1996

[54] METHOD AND APPARATUS FOR MANUFACTURING INTERNAL GEAR, INTERNAL GEAR STRUCTURE AND REDUCTION MECHANISM UNIT HAVING INTERNAL GEAR STRUCTURE

[75] Inventors: Hisanobu Kanamaru, Katsuta; Yasuo Kohashi, Mito, both of Japan

[73] Assignee: Hitachi, Ltd., Japan

[21] Appl. No.: 294,868

[22] Filed: Aug. 29, 1994

Related U.S. Application Data

[63] Continuation of Ser. No. 918,058, Jul. 24, 1992, abandoned.

[30] Foreign Application Priority Data

Jul. 24, 1991 [JP] Japan ..... 3-184594

[51] Int. Cl.[6] ..... B21H 5/02

[52] U.S. Cl. ..... 72/105; 72/110

[58] Field of Search ..... 72/68, 105, 106, 72/110; 29/893.32, 893.34; 475/331

[56] References Cited

U.S. PATENT DOCUMENTS 2,086,488 7/1937 Batie ..... 72/68

3,473,211 10/1969 Lindell ..... 29/893.32

4,671,125 6/1987 Yabunaka ..... 475/331

4,884,427 12/1989 Sawahata et al. .

*Primary Examiner*—Lowell A. Larson

*Attorney, Agent, or Firm*—Evenson, McKeown, Edwards & Lenahan P.L.L.C.

[57] ABSTRACT

A steel sheet material is stamped from a coil stock material to form a disc blank member. The disc blank member is pressed to form an ash tray metal member. The ash tray metal member is sized to form a hollow cylindric metal body having a flange portion, a cylindric porion and a bottom portion by a press working. The cylindric metal body is inserted a central porion of a mandrel having a tooth profile part. The cylindric metal body is clamped and held by a drive shaft and a driven shaft which are rotated together with the mandrel. Under this state, the cylindric portion of the cylindric metal body is pressed by a roller. The metal of the cylindric portion of the cylindric metal body is fluidized plastically along the tooth profile part of the mandrel, thereby an internal gear is formed on the cylindric portion. The internal gear is applied to a reduction gear mechanism starter for use in an automobile.

11 Claims, 5 Drawing Sheets

METHOD AND APPARATUS FOR MANUFACTURING INTERNAL GEAR, INTERNAL GEAR STRUCTURE AND REDUCTION MECHANISM UNIT HAVING INTERNAL GEAR STRUCTURE

This application is a continuation of application Ser. No. 07/918,058, filed on Jul. 24,1993, now abandoned.

BACKGROUND OF THE INVENTION

The present invention relates to a method of manufacturing an internal gear, an internal gear structure and a reduction mechanism unit having an internal gear structure. In particularly, the present invention relates to a method of manufacturing a thin and light-weight internal gear which is provided on a reduction mechanism unit of a starter for use in an automobile. The internal gear structure of the present invention can apply an internal gear structure with which a several planet gears intermesh.

In a method of manufacturing an internal gear and an internal gear structure according to the present invention, a material for forming the internal gear employs a simple shape sheet metal material and this sheet metal material is processed by a press working. This sheet metal material is formed into a hollow cylindric metal body that each portion has an appropriate thickness as an intermediate workpiece and this intermediate workpiece is formed as a completed product of the internal gear structure using a roll forming method.

The roll forming method comprises the steps of: (1) fitting an inner peripheral surface of a cylindric portion of a hollow cylindric metal body into an outer peripheral surface of a mandrel having a tooth profile part; (2) clamping the hollow cylindric metal body at both axial ends thereof to hold the hollow cylindric metal body; (3) rotating the metal hollow cylindric body together with the mandrel, a drive shaft and a driven shaft those are fixed by pressing one other; (4) pressing a roller radically on an outer peripheral surface of the cylindric portion of the hollow cylindric metal body in a direction perpendicular to an axial of the mandrel while rotating the hollow cylindric metal body together with the mandrel; whereby the hollow cylindric metal body is plastically deformed, thereby an internal tooth profile is formed on the inner peripheral surface of the cylindric portion of the hollow cylindric metal body.

As a conventional technique of a reduction mechanism structure having an internal gear structure, various techniques have been developed. Within these techniques, the typical examples of the conventional reduction mechanism structure techniques having the internal gear structure are as follows.

(1) A reduction mechanism structure having an internal gear structure in which a sun gear is provided on a drive shaft and between this sun gear and the internal gear structure several planet gears are disposed to be in intermesh with the sun gear and the internal gear structure.

(2) A reduction mechanism structure having an internal gear structure in which a cum or a crank is provided on a driven shaft, and by the cum or the crank the planet gears intermeshed with the internal gear structure are supported rotatively at each center portion.

(3) A reduction mechanism structure having an internal gear structure in which an external gear is provided on a drive shaft, and this external gear is meshed directly with the internal gear structure so that this internal gear can be rotated by the drive shaft.

Besides, as an example of the conventional method for manufacturing an internal gear structure, there is a non-cutting method shown in U.S. Pat. No. 4,884,427. It shows that a helical internal gear structure is manufactured by a following method. Namely, a hollow cylindric metal body for forming the helical internal gear structure is formed by the roll forming apparatus including a mandrel having a tooth profile part at an outer peripheral surface and a roller.

The helical internal gear structure manufactured by the above stated conventional non-cutting method has the merit in that an accuracy of the tooth profile can be as high as a tooth profile by a conventional cutting method with the reduced number of machining steps.

However, since in generally most of the shape of the hollow cylindric metal body is formed by the forging working, that known method has still following various problems to be improved.

(1) It is difficult to form a thin and light-weight internal gear structure having sufficient strength.

(2) It is difficult to install a boss in the internal gear in order to fix it to a housing or a bracket of a motor etc.

(3) The cost of the material and the processing, including the surface treatment and the thermal treatment to manufacture the internal gear structure is apt to be high.

A method and apparatus for splining clutch hubs is disclosed in, for example U.S. Pat. No. 4,596,127. In this prior art, in pressure forming splines or teeth in an axially extending sleeve of a clutch hub (cup-shaped power transmission member), a pair of special tooth forming racks adapted to intermesh with a toothed mandrel with the sleeve therebetween and a pair of special support racks adapted to contact an oil seal surface are used.

However, in U.S. Pat. No. 4,596,127, since the internal gear is formed by a flat rolling, there is no restriction mechanism which restricts the flow of the metal material toward an axial direction. Though splines of the clutch hub formed by this method, since a regular amount of the metal material does not flow into a portion to be formed the tooth profile part, the internal gear structure having a precise tooth profile part which is enable to intermesh with a several planet gears can not formed by this method.

Besides, in a case that an internal gear structure is formed by a sheet metal material, in generally it can obtain the internal gear structure having a thin thickness structure. When this internal gear structure is adapted to intermesh with several planet gears, it is important to form a strong and rigid internal gear structure so as to intermesh with the planet gears and such a sleeve shape internal gear structure may be easily deformed and so that the above stated internal gear structure can not intermesh with the planet gears.

SUMMARY OF THE INVENTION

An object of the present invention is to provide a method of manufacturing a thin and light-weight internal gear having enough accuracy and strength and a thin and light-weight internal gear structure having enough accuracy and strength wherein the internal gear structure can be formed easily from a simple shape sheet metal material.

Another object of the present invention is to provide a method of manufacturing a thin and light-weight internal gear having enough accuracy and strength and a thin and light-weight internal gear structure having enough accuracy and strength wherein a high strong performance of an internal gear structure can be maintained securely and wherein the internal gear structure can be obtained easily.

A further object of the present invention is to provide a method of manufacturing a thin and light-weight internal gear having enough accuracy and strength and a thin and light-weight internal gear structure having enough accuracy wherein an installation of an internal gear structure to a housing or a bracket of a motor etc. can be carried out accurately.

A further object of the present invention is to provide a method of manufacturing a thin and light-weight internal gear having enough accuracy and strength and a thin and light-weight internal gear structure having enough accuracy wherein the manufacturing cost of an internal gear structure can be reduced remarkably.

To this end, according to the present invention, a method of manufacturing an internal gear comprises the following procedures; (1) forming a sheet metal material into a hollow cylindric metal body having a flange portion, a cylindric portion and a bottom portion as each portion has appropriate thickness by a press working; (2) fitting an inner peripheral surface the cylindric portion of the hollow cylindric metal body into an outer peripheral surface of a mandrel which has a tooth profile part; (3) clamping the hollow cylindric metal body at both axial ends so as to hold the hollow cylindric metal body; (4) rotating the hollow cylindric metal body together with the mandrel; and (5) pressing a roller radically on an outer peripheral surface of the cylindric portion of the hollow cylindric metal body in a direction perpendicular to an axis of the mandrel while rotating the hollow cylindric metal body together with the mandrel; whereby the hollow cylindric metal body is plastically deformed along the tooth profile part on the mandrel by the roller to form teeth part on the inner peripheral surface of the cylindric portion of the hollow cylindric metal body.

Namely, the method of manufacturing the internal gear according to the present invention can apply basically to the above stated roll forming method using the roll forming apparatus including the mandrel having the tooth profile part and the roller.

In the present invention, the steel plate material is used as the internal gear material in place of the hollow cylindric metal body manufactured by the forging according to the conventional technique, this steel plate material is formed as the hollow cylindric metal body having the flange portion, the cylindric portion and a bottom portion by the press working.

According to the present invention, a method of manufacturing an internal gear comprises the following procedures; (1) forming a sheet metal material to a hollow cylindric metal body having a flange portion, a cylindric portion, a bottom portion and a burring portion which has a coaxial hole with the cylindric portion as each portion has appropriate thickness by the press working; (2) fitting the coaxial hole of the burring portion of the hollow cylindric metal body into a coaxial boss of a mandrel; (3) fitting an inner peripheral surface of the cylindric portion of the hollow cylindric metal body into an outer peripheral surface of the mandrel having a tooth profile part; (4) clamping the hollow cylindric metal body at both axial ends thereof so as to hold the hollow cylindric metal body; (5) rotating the hollow cylindric metal body together with the mandrel; (6) pressing a roller radically on an outer peripheral surface of the cylindric portion of the hollow cylindric metal body in a direction perpendicular to an axis of the mandrel while rotating the hollow cylindric metal body together with the mandrel; and (7) plastically deforming the cylindric portion of the hollow cylindric metal body along the tooth profile part on the mandrel by the roller to form the tooth profile part on the inner peripheral surface of the cylindric portion of the hollow cylindric metal body.

Namely, the steel plate material is used as the internal gear material, this steel plate material is formed into the hollow cylindric metal body having the flange portion, the cylindric portion, the bottom portion and the burring portion at the bottom coaxial with the cylindric portion.

Besides, the boss is extended at the front side of the mandrel coaxially with the tooth profile part of the mandrel, this boss is fitted into the burring portion of the hollow cylindric metal body, and the tooth profile part is formed on the inner peripheral surface of the cylindric portion coaxially with an inner peripheral surface of the burring portion of the hollow cylindric metal body with the mandrel and the roller.

According to the present invention, an internal gear structure has a hollow cylindric metal body that comprises a thin flange portion, an appropriate thick cylindric portion, a thin bottom portion and a burring portion, those are formed by the press working on a steel plate material; and the cylindric portion of the hollow cylindric metal body is plastically deformed by the roll forming using the mandrel and the roller to form the tooth profile part on an inner peripheral surface of the cylindric portion of the hollow cylindric metal body, besides the burring portion has a coaxial hole with the tooth profile part on the inner peripheral surface of the cylindric portion of the hollow cylindric metal body.

According to the present invention, the internal gear structure is formed by the sheet metal material and this internal gear structure has the flange portion and the bottom portion, it can be obtained the high strength internal gear structure. Thereby, even the internal gear structure is adapted to intermesh with a several planet gears, it can intermesh with the planet gears.

According to the present invention, the steel plate material is used as the material for the internal gear structure. This is formed into be the hollow cylindric metal body such as each portion has an appropriate thickness; for example a thin flange portion, a thin cylindric portion and a thin bottom portion by the press working. And then the hollow cylindric metal body is done the roll forming using the mandrel and the roller to form the tooth profile part on the inner peripheral surface of the cylindric portion of the hollow cylindric metal body.

Therefore, since the internal gear structure is hardened by the cold plastic working and moreover it has the flange portion and the bottom portion, the internal gear structure has high strength and so it internal gear structure can be also a thin and light-weight structure.

Since the thickness of the cylindric portion of the hollow cylindric metal body can be appropriate the precision of the tooth profile part formed on the cylindric portion by the roll forming can be accurate, because the tooth profile part is formed in the state bringing the roller very close to the tooth profile part of the mandrel and the plastic deformation can be done only in a small limited part.

Further, the flange portion of the internal gear structure can be made easily by the press working, by the flange portion, the internal gear structure can be installed securely on the housing or the bracket of the motor etc.

Since the inner peripheral surface of the burring portion of the internal gear structure made of the steel plate material is formed by the press working in high coaxial precision, and while fitting the coaxial hole of the burring portion of the internal gear structure fits into the boss extended at the front side of the mandrel coaxially with the tooth profile part the above stated roll forming is carried out, so the coaxial precision between the tooth profile part of the internal gear structure and the coaxial hole of the burring portion of the internal gear structure can be kept high.

Since the inner peripheral surface of the burring portion of the internal gear structure can support a drive shaft or a driven shaft for power transmission through the bearing member, accordingly the internal gear structure can be installed on the drive shaft or the driven shaft with the high coaxial precision.

Further, since the above stated internal gear structure is manufactured only by the press working and the roll forming a cheap steel plate material namely the cold plastic working without requiring cutting nor grinding, the number of steps the process and the manufacturing cost can be reduced compared with an internal gear structure manufactured by the conventional method.

DESCRIPTION OF THE INVENTION

Figure 1:
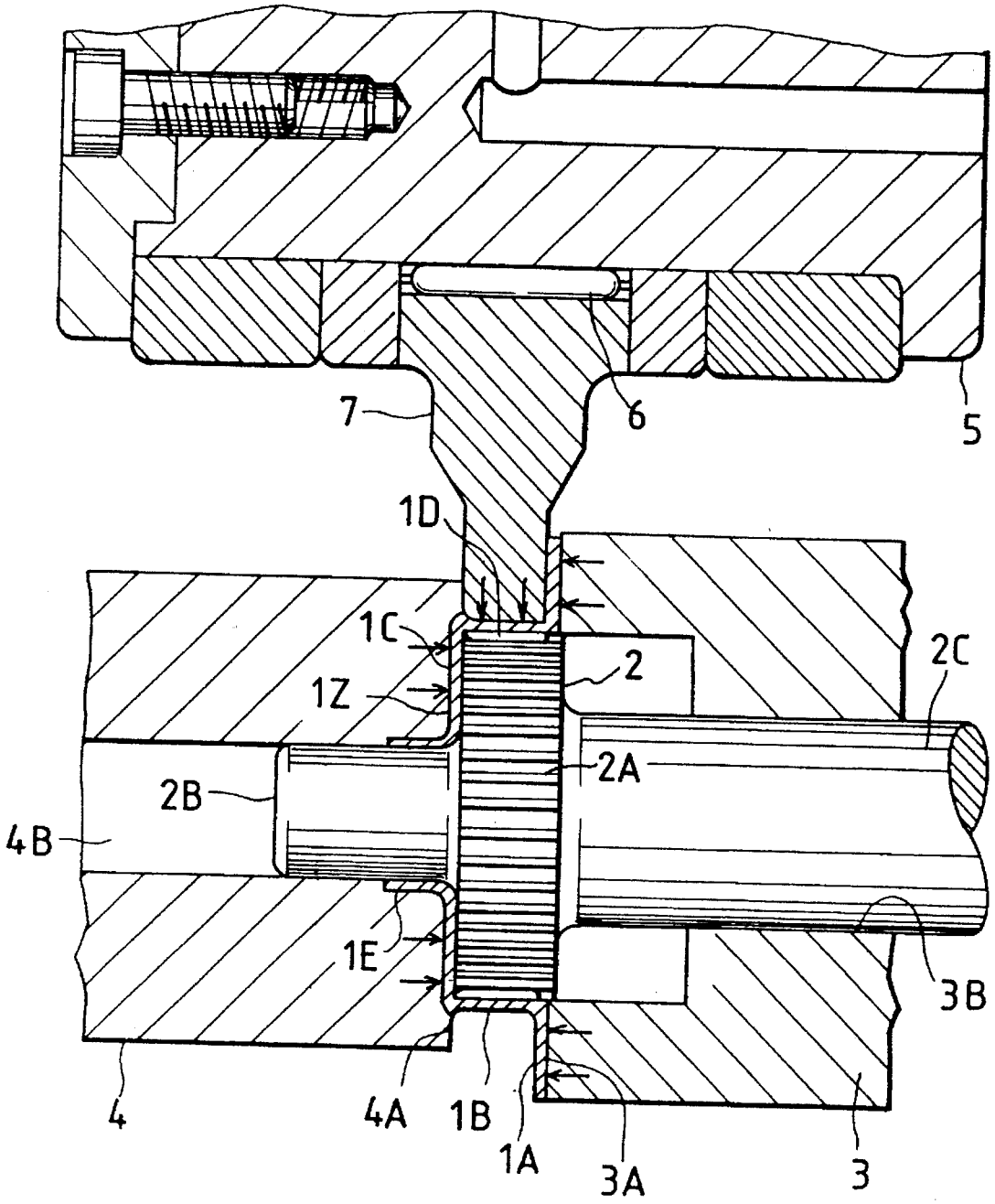
FIG. 1 is a partially cut-off longitudinal cross-sectional view of an apparatus which shows one embodiment of a method of forming a tooth profile part on an inner peripheral surface of an internal gear structure according to the present invention.

One embodiment of a method of manufacturing an internal gear according to the present invention will be explained referring to the drawings.

FIG. 1 illustrates a roll forming apparatus for forming an internal tooth profile part on an internal gear of a reduction gear mechanism unit of a starter for use in an automobile; FIGS. 2A–2F are a hollow cylindric metal body and a completed product thereof the internal gear structure made of a steel plate material and they are formed by a cold plastic forming according to the present invention; and FIG. 3 is a partially cross-sectional view showing the internal gear structure as a completed product.

Main points of a manufacturing process of the internal gear according to the present invention will be explained referring to FIG. 2A–FIG. 2F.

Figure 2A:
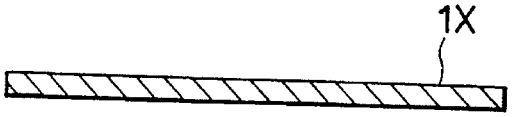
FIGS. 2A–2D are longitudinal cross-sectional views of a hollow cylindric metal body of an internal gear structure showing one embodiment of the manufacturing process according to the present invention.
Figure 3:
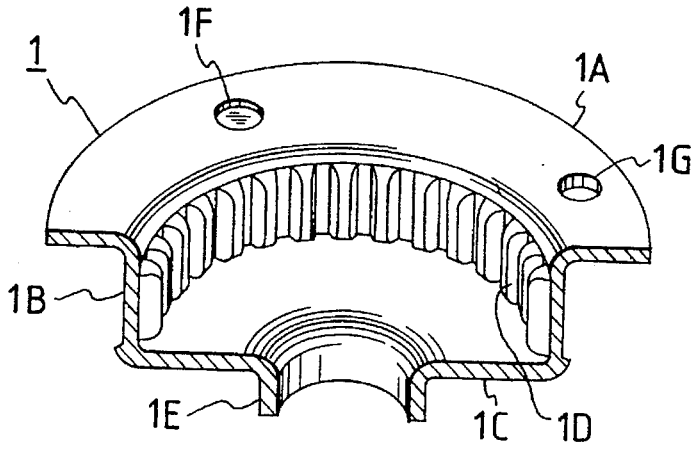
FIG. 3 is a partially cut-off sectional perspective view showing the internal gear structure in accordance with the method of the present invention.

First of all, as shown in FIG. 2A, a disc shape blanc member 1X made of a steel plate material, for example a 2.6 mm thickness cold-rolled steel plate material, as a first intermediate workpiece for an internal pear structure 1 is manufactured by the stamping from a coil stock material.

Figure 2D:
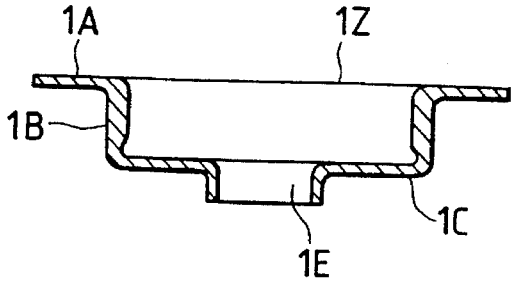
Figure 2B:
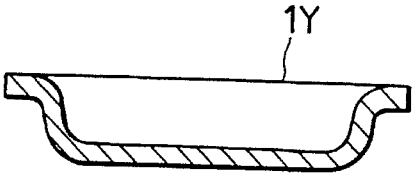

Next, this stamped disc shape blanc member 1X is formed into an dish-like shape metal member 1Y as a second intermediate workpiece shown in FIG. 2B by the drawing die.

Next, the second intermediate workpiece 1Y (the dish-like shape metal member) is punched a hole at a center bottom portion and becomes a third intermediate workpiece. As a result, this third intermediate workpiece 1Y has the shape having a punched hole portion 1E' at the center bottom portion, as shown in FIG. 2C.

After that this third intermediate workpiece 1Y is sized to a thin flange portion 1A (for example 1.6 mm thickness), a appropriate thick cylindric portion 1B (for example, 2.6 mm thickness) and a thin bottom portion 1C (for example 1.6 mm thickness) precisely and simultaneously it is carried out the burring working so as to form a thin burring portion 1E (for example, 1.2 mm thickness) at the center bottom portion and then becomes a fourth intermediate workpiece 1Z, as shown in FIG. 2D.

In this embodiment of the present invention, hereinafter the fourth intermediate workpiece 1Z is called as the hollow cylindric metal body. Namely, the hollow cylindric metal body 1Z is defined to comprise the flange portion 1A, the cylindric portion 1B and the bottom portion 1C having the burring portion 1E.

Figure 2E:
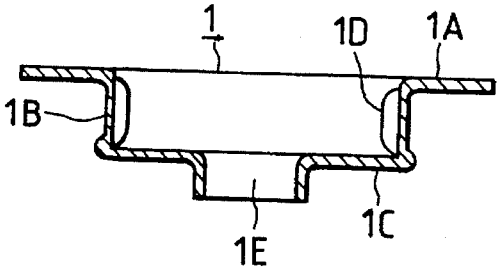
FIGS. 2E–2F are longitudinal cross-sectional views of a completed product of an internal gear structure showing one embodiment of the manufacturing process according to the present invention.
Figure 2C:
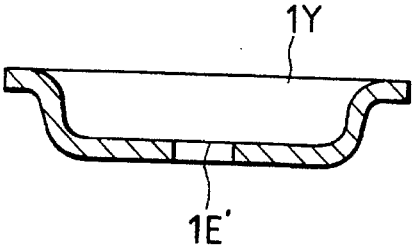
Figure 2F:
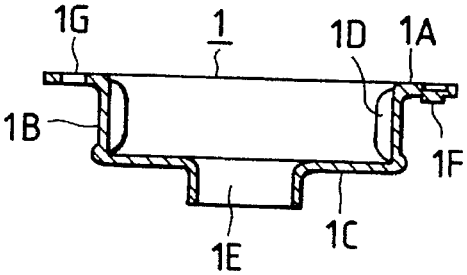

Next, using a roll forming apparatus shown in FIG. 1, this hollow cylindric metal body 1Z is formed to make an internal tooth profile part 1D at an inner peripheral surface of the hollow cylindric metal body 1Z as the internal gear structure 1, as shown in FIG. 2E. For example, the difference between the outer diameter of the cylindric portion 1B and the tooth profile diameter is 1.4 mm. After those procedures, holes 1G for through bolts and stopping projections are installed on the flange portion 1A of the internal gear structure 1 as shown in FIG. 2F.

Herein, the above process shown in FIG. 2E will be explained more detail referring to FIG. 1. As shown in FIG. 1, the hollow cylindric metal body 1Z is clamped at both axial sides a driven shaft (follow shaft) 4 and a drive shaft (main drive shaft) 3. The drive shaft 3 has a retainer at a tip end side and the driven shaft 4 has another retainer at a tip end side. Usually the retainers are used as an ejector for the internal gear structure 1 from the roll forming apparatus. However, it may not provide the retainer at the drive shaft 4.

Two retainers provided on the drive shaft 3 and the driven shaft 4 are used to clamp and hold the hollow cylindric metal body 1Z at the opposite axial ends of the portion thereof to be able to rotate with the mandrel 2 and formed by the roll forming. Or one retainer of the driven shaft 3 and the driven shaft 4 are used to clamp and hold the hollow cylindric metal body 1Z.

The mandrel 2 comprises a gear profile unit 2A at an outer peripheral surface, a coaxial boss 2B at a front side and a shaft main body 2C at a rear side. The tooth profile part 2A of the mandrel 2 is disposed between the boss 2B and the shaft main body 2C. By fitting into the center hole of the main drive shaft 3, the mandrel 2 is fixed on the main drive shaft 3.

The bottom portion 1C of the hollow cylindric metal body 1Z is disposed between the concave portion of the driven shaft 4 and the side face of the tooth profile part 2A of the mandrel 2. The inner peripheral surface of the cylindric portion 1B of the hollow cylindric metal body 1Z is disposed around the tooth profile part 2A of the mandrel 2 to form a tooth profile part 1D on the cylindric portion 1B of the hollow cylindric metal body 1Z.

The inner peripheral surface of the cylindric portion 1B of the hollow cylindric metal body 1Z is fitted onto a die on the mandrel 2 which the die is provided on the outer peripheral surface thereof with the tooth profile part 2A. The hollow cylindric metal body 1Z of the internal gear structure 1 made by the manufacturing processes shown in the figures comprising from FIG. 2A to FIG. 2D is inserted into the boss 2B of the mandrel 2 of which the tooth profile part 2A are formed at an outer peripheral surface.

At the front side of the mandrel 2, the boss 2B is provided extendingly and at this boss 2B an inner peripheral surface of the burring portion 1E of the hollow cylindric metal body 1Z is inserted under the fitting state.

The end face 4A of the driven shaft 4 has L-shaped concave portion. The bottom portion 1C and the burring portion 1E of the hollow cylindric metal body 1Z are placed on this concave portion of the driven shaft 4. An upper portion of the flange portion 1A of the hollow cylindric metal body 1Z is placed on the one end face 3A of the main drive shaft 3. So the cylindric portion 1B of the hollow cylindric metal body 1Z is placed on between the main drive shaft 3 and the driven shaft 4.

The burring portion 1E of the hollow cylindric metal body 1Z is disposed between the boss 2B of the mandrel 2 and the concave portion of the driven shaft 4. The inner peripheral surface of the burring portion 1E of the hollow cylindric metal body 1Z is disposed around the outer peripheral surface of the boss 2B of the mandrel 2.

The boss 2B of the mandrel 2 and the burring portion 1E of the hollow cylindric metal body 1Z are inserted into a center hole 4B of the driven shaft 4. At a core hole 3B of the main drive shaft 3, the shaft main body 2C of the mandrel 2 is inserted, respectively. With this state, by one end 3A of the main drive shaft 3 and one end face 4A of the driven shaft 4 the hollow cylindric metal body 1Z is clamped at the both axial sides. Both of the main drive shaft 3 and the driven shaft 4 can rotate together with the mandrel 2 as one.

In this embodiment of the present invention, one end face of 3A of the main drive shaft 3 is clamped one face of the flange portion 1A of the hollow cylindric metal body 1Z and one end face 4A of the driven shaft 4 is clamped the bottom portion 1C of the hollow cylindric metal body 1Z by pressing one each another.

The main drive shaft 3 rotates together with the mandrel 2, the hollow cylindric metal body 1Z and the driven shaft 4. And while rotating the hollow cylindric metal body 1Z, the roller 7 presses radically the outer peripheral surface of the cylindric portion 1B of the hollow cylindric metal body 1Z in a direction perpendicular to the axis of the direction against the rotational axis of the mandrel 2.

Accordingly, the plastic deformation of the hollow cylindric metal body 1Z along the tooth profile part 2A of the mandrel 2 by the roller 7 to form the tooth profile part 1D on the inner peripheral surface of cylindric portion 1B of the hollow cylindric metal body 1Z is carried out. The hollow cylindric metal body 1Z receives the force as shown in an arrow mark in FIG. 1.

By the manufacturing method according to the present invention, since a regular amount of the metal material flows into a portion to be formed the tooth profile part, the internal gear structure has a precise tooth profile part which is enable to intermesh with a several planet gears.

A support shaft 5 is arranged in parallel with the mandrel 2 and is movable close to apart from the mandrel 2. The support shaft 5 carries the roller 7 through a needle bearing member 6.

In operation, the main drive shaft 3 is rotated by the primer mover, so that the hollow cylindric metal body 1Z is also rotated. At the same time, the roller 7 is pressed onto the cylindric portion 1B of the hollow cylindric metal body 1Z in a radial inward, namely in a direction perpendicular to an axis of the mandrel 2.

In consequence, the cylindric portion 1B of the hollow cylindric metal body 1Z clamped between the main drive shaft 3 and the driven shaft 4 is plastically deformed along the groove of the tooth profile part 2A during the rotation thereof, which does not restrict such plastic deformation of the hollow cylindric metal body 1Z, whereby the tooth profile part 1D as shown in FIG. 3 is formed on the inner peripheral surface of the cylindric portion 1B of the hollow cylindric metal body 1Z.

Figure 4A:
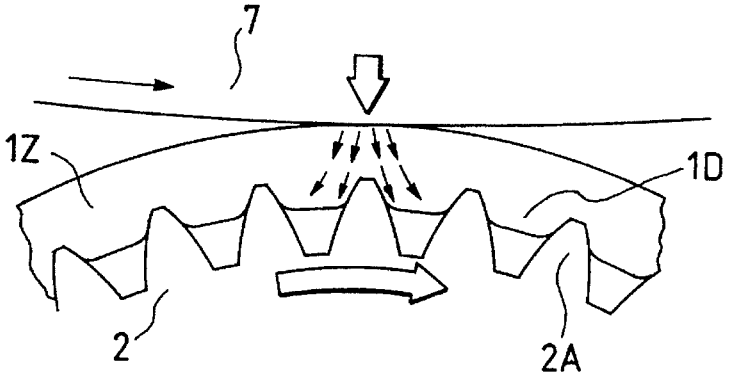
FIG. 4A is a latitudinal cross-sectional view showing an internal gear structure, a mandrel and a roller under the tooth profile forming process.
Figure 4B:
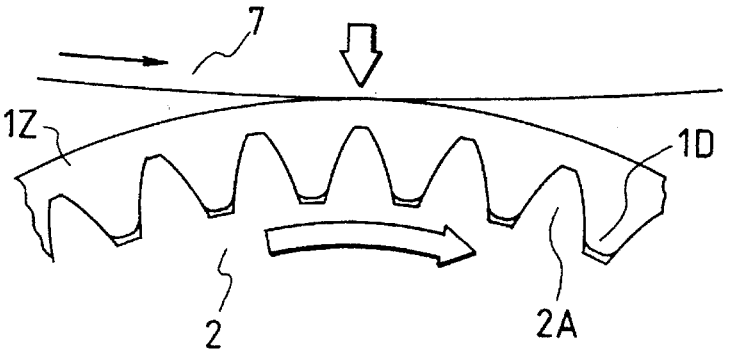
FIG. 4B is a latitudinal cross-sectional view showing an internal gear structure, a mandrel and a roller when the gear forming process is completed.

Besides, the tooth profile forming process for manufacturing the internal tooth profile part 1D of the cylindric portion 1B of the hollow cylindric metal body 1Z on the inner peripheral surface using the mandrel 2 and the roller 7 is shown in FIG. 4A. Further, FIG. 4B shows the state that forming the internal tooth profile part 1D of the cylindric portion 1B of the hollow cylindric metal body 1Z has been completed.

The dimensions of the hollow cylindric metal body 1Z obtained by the present invention will be exemplified. The hollow cylindric metal body 1Z has a gear module 1.15, the thickness of the flange portion 1A is 1.6 mm, the thickness of the cylindric portion 1B excluding the tooth thickness is 0.7 mm, the thickness of the bottom portion 1C is 1.6 mm and the thickness of the burring portion 1E is 1.2 mm, respectively.

According to the above stated method of manufacturing the internal gear structure 1, the hollow cylindric metal body 1Z for the internal gear structure 1 can be formed easily by the press working. And while forming the tooth profile part 1D on the inner peripheral surface of the cylindric portion 1B of the hollow cylindric metal body 1Z is done by the cold roll forming, the axial inner peripheral surface of the cylindric portion 1B fits on the tooth profile part 2A of the mandrel 2 during the forming the tooth profile part 1D by the cold roll forming.

In consequence, a high degree of coaxial precision with the inner peripheral surface of the burring portion 1E of the hollow cylindric metal body 1Z can be readily attained to meet the design demand.

In addition the tooth profile part 1D of the hollow cylindric metal body 1Z can be formed with a high degree of precision, because of the cold roll forming so that the necessity for any subsequent finish processing can be eliminated. Thus, it is unnecessary to conduct a milling or other machining operation for the purpose of forming the internal gear structure 1. In consequence, the improvement is achieved both in the yield and the production efficiency. Accordingly, not only the accuracy in the tooth profile part 1D of the internal gear structure 1 but also the coaxial precision between the inner peripheral surface of the burring portion 1E of the hollow cylindric metal body 1Z and the tooth profile part 1D of the internal gear structure 1 can be kept securely.

Further, since the relief at the both longitudinal flank of the processed tooth profile part 1D of the internal gear structure 1 is formed instinctively as the merit by the roll forming, it is unnecessary to carry out the tooth flank relief work, although necessary in a case of a cutting tooth profile part.

It is also to be noted that the internal tooth profile part 1D formed by the method of the present invention is work-hardened by virtue of the use of the roll forming, so that it is unnecessary to quench hardening after the formation of the tooth profile part 1D of the hollow cylindric metal body 1Z.

Further, although the hollow cylindric metal body 1Z in this embodiment of the present invention has bottom portion 1C and high strength, and forming the internal tooth profile part 1D on the hollow cylindric metal body 1Z by the conventional working method, for example broaching etc., is difficult.

Accordingly to this embodiment of the present invention, the tooth profile part 1D on the inner peripheral surface of the hollow cylindric metal body 1Z can be formed easily and accurate by the cold roll forming.

In this embodiment of the present invention, because of the flange portion 1A and the bottom portion 1C, the internal gear structure 1 has the thin and light-weight structure and the high strength.

Figure 5:
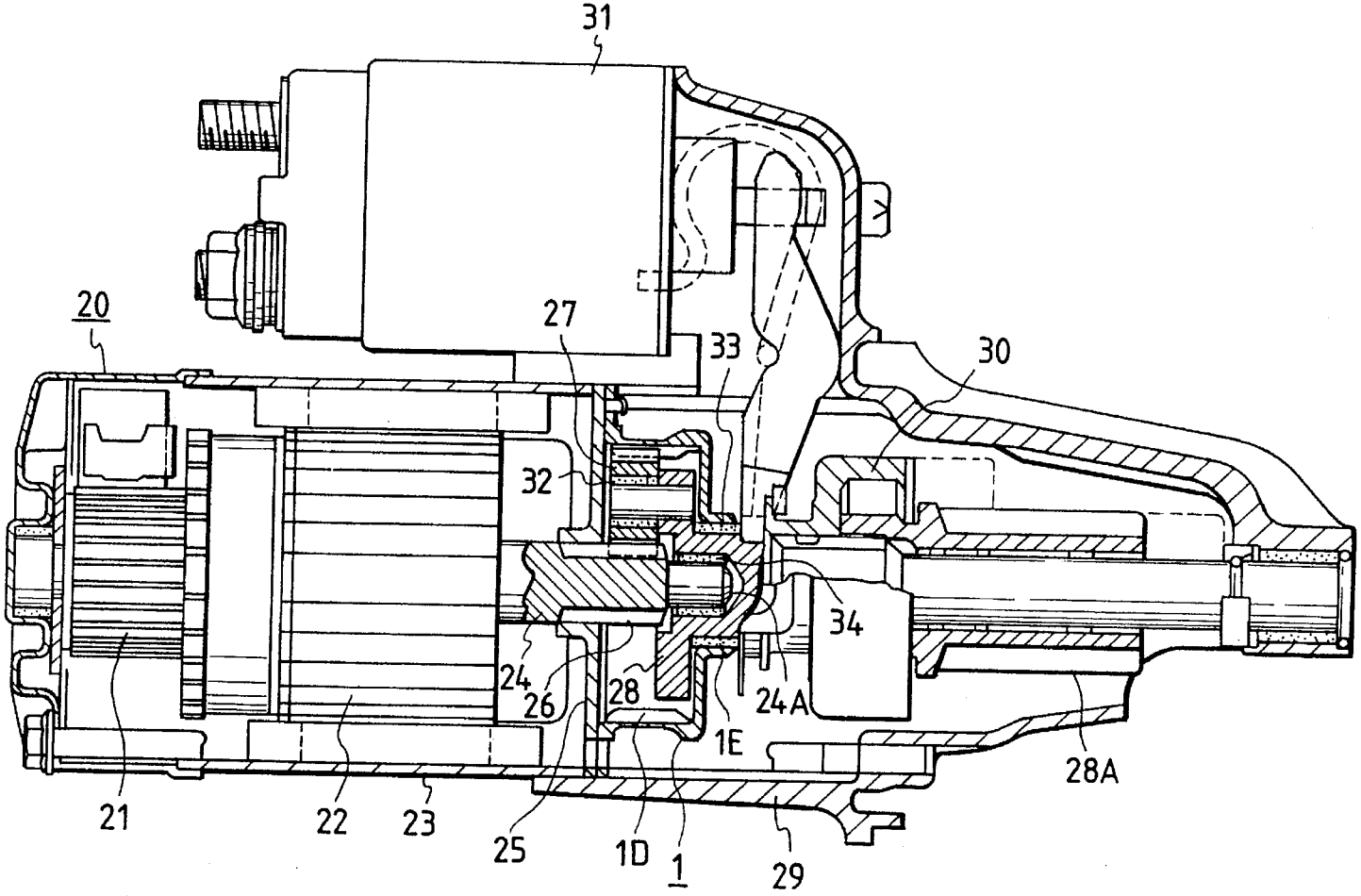
FIG. 5 is a partially cut-off cross-sectional view showing a starter for use in an automobile including a reduction gear mechanism unit having the internal gear structure in accordance with the method of the present invention.

FIG. 5 shows is a partially cross-sectional view showing a starter structure having a reduction gear mechanism for starting an engine of an automobile. In this reduction gear mechanism unit of the starter, the internal gear structure 1 manufactured by the above stated method is applied.

Figure 6:
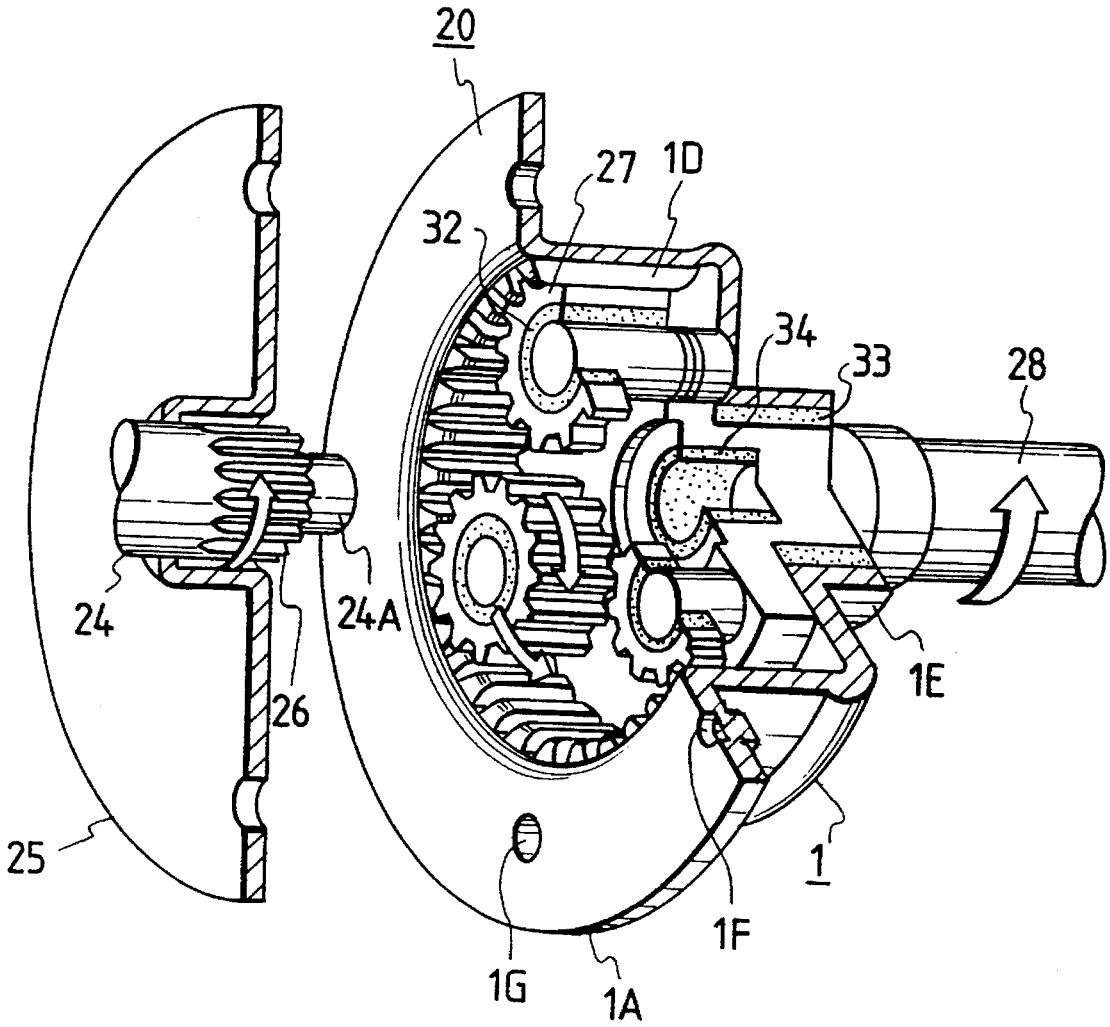
FIG. 6 is a partially sectional perspective view showing the reduction gear mechanism unit having the internal gear structure of the starter.

In FIG. 5 and FIG. 6, the starter structure 20 (starting motor structure) employs a reduction gear type starter. The starter 20 comprises mainly a motor unit, a reduction gear mechanism unit, a pinion unit, a clutch unit and a switch unit.

The motor unit comprises a commutator 21, a core 22, a yoke 23, an armature shaft 24 and a motor bracket 25. The armature shaft 24 has a front end portion 24A and provides a sun gear 26 at an outer peripheral surface thereof.

The motor bracket 25 installs securely the internal gear structure 1, namely the flange portion 1A of the internal gear structure 1 is mounted securely on the motor bracket 25 of the starter 20 using the installation holes 1G and the stopping boss 1F of the internal gear structure 1.

A clutch sleeve 30 is provided on a pinion shaft 28 (follow shaft) and a gear case 29 is surrounded the internal gear structure 1 and the pinion shaft 28 mounting the clutch sleeve 30. The switch portion of the starter 20 has a magnet switch 31.

The sun gear 26 is provided on the armature shaft 24 of the commutator motor of a starter motor. The internal gear structure 1 is installed securely on the motor bracket 25 for supporting the armature shaft 24, via the pinion shaft 28 by the flange portion 1A and the burring portion 1E of the internal gear structure 1. The holes 1G for through the bolts and the stopping boss 1F to fit into the hole of the gear case 29 of it.

Between the sun gear 26 and the internal gear structure 1 three planet gears 27 are disposed in the intermeshing state. Three planet gears 27 are mounted on one end of the pinion shaft (follow shaft) 28 having pinion 28A via the planet gear shafts and a first bearing member 32. The pinion shaft 28 is fitted to the inner peripheral surface of the burring portion 1E and supported by it of the internal gear structure 1 via a second bearing member 33.

At a front end of the pinion shaft 28, the subassembly of the pinion 28A and the clutch sleeve 30 is mounted through a helical spline on it by rotating together with the pinion shaft 28. The subassembly is mounted to the helical spline on the shaft so as to be moved in the thrust direction by the motive power of a magnetic shift lever.

The pinion shaft 28 and the armature shaft 24 are disposed on the same coaxial axis and the front end portion 24A of the armature shaft 24 is fitted into the center hole of rear end of the pinion shaft 28 via a third bearing member 34.

About the above stated reduction gear mechanism for use in the automobile starter structure, in addition to the merits stated above of the internal gear structure 1, the manufacturing cost for not only this kind of the reduction gear mechanism but also the automobile reduction gear type starter structure 20 can be reduced remarkably. Further, the coaxial precision between the sun gear 26 of the armature shaft 24 and the internal gear structure 1 can be made accurate.

The processing method shown in the embodiment of the present invention can be applied to not only an involute but also various shape gear profile of the internal gear structure.

According to the above embodiment of the present invention about an internal gear structure the following effects can be obtained.

(1) Because of a material of a work-hardened steel plate and a shape having the flange portion 1A and the bottom portion 1C, the internal gear structure 1 can keep high strength and can be the thin and light-weight structure.

Since the flange portion 1A and the bottom portion 1C are provided on the internal gear structure 1, the internal gear structure 1 can be kept the high strength thereby the internal gear structure 1 can be made one having the accuracy dimension.

Since the internal gear structure 1 having the flange portion 1A and the bottom portion 1C can not deform, the internal gear structure 1 can be intermeshed correctly with the planet gears 27.

(2) Since the thickness of the cylindric portion 1B of the hollow cylindric metal body 1Z can be appropriate and so that the tooth profile part 1D can be formed in the state bringing the roll very close to the tooth profile part 2A of the mandrel 2, besides the plastic deformation can be done only in a small limit part, the precision of the tooth profile part 1D formed on the cylindric portion 1B of the hollow cylindric metal body 1Z by the roll forming can be accurate.

(3) A complicated shape internal gear structure 1 having the flange portion 1A can be formed by the cold plastic forming and an installation of the internal gear structure 1 to a housing or a bracket of motor etc. can be carried out securely.

Since the installation member of the holes 1G and the boss 1F is provided on the flange portion 1A of the internal gear structure 1, using the above installation member the internal gear structure 1 can be installed easily to the housing or the bracket of motor etc.

(4) Because of a material of a work-hardened steel plate used widely in general and being formed only by the cold plastic working without cutting, the internal gear structure 1 can be manufactured at low cost.

(5) The high coaxial precision between the internal gear structure 1 and the drive shaft 3 or the driven shaft 4 is kept by doing follows.

(a1) The coaxial inner peripheral surface of the burring portion 1E is installed at the bottom portion 1C of the hollow cylindric metal body 1Z by the press working.

(a2) And then forming the tooth profile part 1D on the inner peripheral surface of the cylindric portion 1B of the hollow cylindric metal body 1Z is done by the cold roll forming while the coaxial inner peripheral surface of the burring portion 1E is fitted by the coaxial boss 2B of the mandrel 2.

(a3) Further, the drive shaft 3 or the driven shaft 4 is fitted to the inner peripheral surface of the burring portion 1E of the hollow cylindric metal body 1Z and supported by it of the internal gear structure 1.

We claim:

1. A method of manufacturing an internal gear comprising the steps of;

forming by press working a sheet metal material as a hollow cylindrical metal body having a radially extending flange portion with a free end, a bottom portion, and a cylindrical portion between said flange portion and said bottom portion, with each portion having a predetermined thickness;

fitting a peripheral surface of said cylindrical portion onto a mandrel having a tooth profile part on a peripheral surface thereof;

clamping and holding opposed axial end faces of said flange portion between a first member and a roller, and opposed axial end faces of said bottom portion between a second member and said mandrel;

rotating said hollow cylindrical metal body together with said mandrel; and pressing said roller against an outer peripheral surface of said cylindrical portion in a direction perpendicular to an axis of said mandrel while rotating said hollow cylindrical metal body together with said mandrel;

whereby said hollow cylindrical metal body is plastically deformed along said tooth profile part of said mandrel by said roller to form a tooth profile part on an inner peripheral surface of said cylindrical portion.

2. A method of manufacturing an internal gear according to claim 1, wherein said forming step comprises first stamping said sheet metal material of a coil stock material to form a disc shape blank member; and pressing said disc shape blank member to form it into a dish-like metal member.

3. A method of manufacturing an internal gear according to claim 2, wherein said forming step comprises shaping said a dish-like shape metal member into said hollow cylindrical metal body.

4. A method of manufacturing an internal gear according to claim 1, wherein said forming step comprises forming at least one installation member on said flange portion.

5. A method of manufacturing an internal gear according to claim 1, wherein said forming step comprises forming at least one boss member on said flange portion.

6. A method of manufacturing an internal gear according to claim 1, wherein the axial end of said flange portion is located more radially outward from an axis of said cylindrical portion than said bottom portion.

7. A method of manufacturing an internal gear comprising the steps of;

forming by press working a sheet metal material as a hollow cylindrical metal body having a radially extending flange portion with a free end, a bottom portion, a cylindrical portion between said flange portion and said bottom portion, and a burring portion having a hole centrally of said bottom portion with each portion having a predetermined thickness;

fitting said hole of said burring portion into a peripheral surface of a boss of a mandrel;

fitting a peripheral surface of said cylindrical portion of said hollow cylindrical metal body onto a mandrel die having a tooth profile part on a peripheral surface thereof;

clamping and holding opposed axial end faces of said flange portion between a first member and a roller and opposed axial end faces of said bottom portion between a second member and said mandrel rotating said hollow cylindrical metal body together with said mandrel; and pressing said roller against a substantially entire outer peripheral surface of said cylindrical portion of said hollow cylindrical metal body in a direction perpendicular to an axis of said mandrel while rotating said hollow cylindrical metal body together with said mandrel;

whereby said hollow cylindrical metal body is plastically deformed along said tooth profile part on said mandrel die by said roller to form a tooth profile part on an inner peripheral surface of said cylindrical portion of said hollow cylindrical metal body.

8. A method of manufacturing an internal gear according to claim 7, wherein said forming step comprises first stamping said sheet metal material of a coil stock material to form a disc shape blank member; and pressing said disc shape blank member to form it into a dish-like shape metal member.

9. A method of manufacturing an internal gear according to claim 7, wherein said forming step comprises shaping a said dish-like shape metal member into said hollow cylindrical metal body.

10. A method of manufacturing an internal gear according to claim 7, wherein said forming step comprises forming at least one installation member on said flange portion.

11. A method of manufacturing an internal gear according to claim 7, wherein the axial end of said flange portion is located more radially outward from an axis of said cylindrical portion than said bottom portion.

* * * * *